US011332896B2

(12) United States Patent
Newcomb

(10) Patent No.: US 11,332,896 B2
(45) Date of Patent: May 17, 2022

(54) CENTRIC PIER SYSTEM AND METHOD

(71) Applicant: David Newcomb, Raytown, MO (US)

(72) Inventor: David Newcomb, Raytown, MO (US)

( * ) Notice: Subject to any disclaimer, the term of this patent is extended or adjusted under 35 U.S.C. 154(b) by 116 days.

(21) Appl. No.: 16/870,664

(22) Filed: May 8, 2020

(65) Prior Publication Data

US 2020/0270827 A1 Aug. 27, 2020

Related U.S. Application Data

(63) Continuation-in-part of application No. 16/279,496, filed on Feb. 19, 2019, now abandoned.

(51) Int. Cl.
*E01D 19/02* (2006.01)

(52) U.S. Cl.
CPC ..... *E01D 19/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,694,538 | A | 11/1954 | Consoo et al. | |
| 2,801,522 | A | 9/1957 | Kuhn | |
| 3,222,030 | A | 12/1965 | Thorpe | |
| 3,347,002 | A | 10/1967 | Fenkuhn | |
| 4,188,681 | A | 2/1980 | Tada et al. | |
| 5,819,482 | A | 10/1998 | Belke et al. | |
| 6,324,795 | B1 | 12/2001 | Stiles et al. | |
| 6,352,391 | B1 | 3/2002 | Jones | |
| 6,817,810 | B2 | 11/2004 | Jones | |
| D613,881 | S | 4/2010 | Perko | |
| 8,206,063 | B2 | 6/2012 | Patton | |
| 8,851,800 | B2 | 10/2014 | Patton | |
| 9,631,335 | B2 | 4/2017 | Reusing et al. | |
| 2003/0033760 | A1* | 2/2003 | Rogers | E02D 27/34 52/167.7 |
| 2010/0166504 | A1 | 7/2010 | Patton | |
| 2012/0255242 | A1* | 10/2012 | Patton | B66F 3/24 52/126.6 |
| 2014/0041334 | A1 | 2/2014 | Patton | |
| 2018/0339750 | A1 | 11/2018 | Knapp et al. | |

FOREIGN PATENT DOCUMENTS

| | | | |
|---|---|---|---|
| GB | 191201093 A | * | 2/1912 |
| JP | SY127EPC-5102 | | 1/1998 |

* cited by examiner

*Primary Examiner* — Kyle Armstrong
(74) *Attorney, Agent, or Firm* — Arthur Shaffer; McDowell Rice Smith & Buchanan

(57) ABSTRACT

The present invention provides an improved centric pier system and method for installation which in one embodiment includes a torsion adapter configured for slidable receipt of a torsion block assembly with a spherical support and a spherically rotatable torsion coupler; the torsion block assembly extending through a channel presented by vertical support at the torsion adapter which is aligned with the torsion block and the vertical support.

7 Claims, 10 Drawing Sheets

CENTRIC PIER SYSTEM AND METHOD

CROSS REFERENCE TO RELATED APPLICATION

This application is a continuation-in-part to the non-provisional application Ser. No. 16/279,496 filed on Feb. 19, 2019.

FIELD OF THE INVENTION

The present disclosure generally relates to the field of vertical support systems and more particularly, to an improved pier support system which includes a stackable vertical support structure with an inner and an outer structure, supporting a rotatable torsion assembly which allows for improved support of a building structure.

BACKGROUND OF THE INVENTION

Piering systems have been used for at least two hundred years to lift and stabilize foundations of structures and for new construction when shifting foundations are anticipated. Many of these systems are related to patents as far back as the late 1800s and were used to push "hollow tubular column sections" to load bearing strata to support against shifts in existing buildings or other structures.

Some piering systems utilize vertical shafts driven into the ground to support an load structure, others employ vertical piers or piles that are driven into the ground adjacent to the foundation. Some piering systems employ helical piles that are screwed into the ground. In some cases, these piers and piles are used to support structures (e.g., walls, bridges, houses or buildings) that are subject to shifting loads or anchor structures (e.g., large antennas, or pylons for high voltage lines) that are subject to large wind loads.

Conventional pier systems have a vertically adjustable, elongated shaft with a load bearing plate permanently fixed to the vertically adjustable shaft. The shaft can either be solid or tubular with the load bearing plate having a substantially planar surface. Many conventional pier systems are either eccentric or concentric. Eccentrically driven piers are typically offset from the center of the supported load, often adjacent to the supported load such as a helical pier. Concentrically driven piers are typically installed directly underneath the center of the supported load surface and are traditionally used in new construction. Both have advantages and disadvantages, but in general they are not used interchangeably. That means that when the need exists for a concentrically driven pier, an eccentric pier will be less than ideal. Likewise, use of a concentric pier in an eccentric pier application is less than ideal. Therefore, there exists a need for an improved support pier which has the advantages of both the eccentric and concentric pier systems without all of the disadvantages.

Over time the footing that a support structure rests upon can shift. Conventional eccentric piers are driven vertically into the earth adjacent to the footing and placed below the footing at 90 deg. using a support bracket. These support brackets are often placed over the vertical shafts in close proximity to the supported surface. After installation, support brackets may have some deviation which offsets the load off from dead center. As the soil expands and contracts the supported structure may shift, which causes the alignment between the support bracket and the vertical shaft to shift. Shifting of these supports causes the support bracket to become off-center. Therefore, there exists a need for an improved pier system which provides support as the supported load shifts off-center.

In some cases, support piers may utilize a ball and/or socket type connection. Over time the connection may shift uncontrollably and require grout or shims to fill in the void or remain level. Even with the addition of grout or shims, the eccentric piers may fail as their orientation shifts uncontrollably away from a horizontal orientation. Therefore, there is a need for a controlled rotatable pier support system which provides improved support as the supported structure shifts, thus reducing the need to add additional shims or grout.

In a conventional pier support system, the load bearing plate is often welded to a vertical shaft to securely maintain the load bearing plate. Welding the junction between the bearing plate and the vertical shaft in a substantially horizontal orientation may allow for a secure joint in the fixed orientation; however, it prevents or limits the ability of the bearing plate to rotate or adjust as needed. In addition, as the supported surface shifts the allowable load may be exceeded as a result of the lack of rotation of the bearing plate reducing the region of contact between the bearing plate and the overlying supported surface. Therefore, there exists a need for providing an improved piering system which allows for rotation of the load bearing plate for better support of the supported load.

In addition, shifting loads may alter the contact angle between the footing (not shown) and a traditional load bearing plate associated with a conventional support pier. This altered contact angle may reduce the contact surface the footing (not shown) and the conventional support pier (not shown) which over time may increase the supported load. If sufficiently high, the supported load may exceed the load capacity of the conventional support pier and may cause a traditional support pier to fail or become unstable. Uncontrolled rotation may result in insufficient support from the underlying vertical shaft thus causing the support to fail. Therefore, there exists a need for an improved pier system which provides for an adjustable load bearing surface which maintains sufficient support and better contact between the load bearing plate and the supported load surface.

The improved pier support system seeks to provide for limited rotation of the load bearing surface while providing for greater load bearing contact surface during the life of the support. By allowing for installation in a variety of locations with respect to the support footing, both eccentric and centric the improved pier support system is usable in a variety of situations. In addition, because the improved pier support system allows for minimal excavation and provides support in both eccentric and centric environments, the site preparation can be much less costly and evasive. Because of the controlled rotatability, the improved pier support system integrally enhances the structures stability, reliability and durability, and reduces wear on pre-graded sites. Each of these desirable characteristics will create significant cost and quality advantages over other foundation systems presently used. A large number of residential and commercial structures have a foundation system that includes concrete piers or footings poured into excavated holes in the ground. Concrete blocks, steel stands, or jacks are stacked on top of the concrete piers, and wooden shims are used for leveling. Finally, cable tie-downs are used to anchor the home against high winds. These foundation support methods are obsolete and unduly labor-intensive.

The present invention provides the additional benefit that a reduction in excavation means and reduction in excavated soil is permitted with installation of the present invention, thereby avoiding additional earth hauling. In addition, because the installation is less evasive, the job site can be repaired easier with sod or grass seed to protect against further soil erosion with may lead to even greater shifting in the supported load. By providing for a less invasive job site with less excavation, the present invention reduces the risk that standing water will freeze or that surrounding soil will become excessively week. The location and quantity of installed piers with lifters can be customized for each job site to match the actual footprint of the supported structure. Because installation of the current invention is easier, it also reduces construction costs based on a reduction of necessary materials and labor at the job site. In addition, since no cement is necessary, large cement trucks are not required at the site, thereby reducing damage to roads and property. In addition, work crews are not required to wait for concrete to harden. Home leveling requires only that the piers be telescoped, and secured to the support structure at a specified height, and adjusted over time as desired. This procedure reduces worktime beneath the home, thereby increasing worker safety and reducing project cost.

Based in part on the foregoing challenges, there exists a need for an improved pier support system which provides for an adjustable load bearing surface which is rotatable along three-axis for stabilizing a footing of a support structure.

SUMMARY OF THE INVENTION

The need for the present invention are met, to a great extent, by the present invention wherein in one aspect a system and method is provided that in some embodiments will present an improved unicentric piering system which allows for rotatable contact between a torsion assembly and an impact plate adapted for placement below a building support.

One embodiment of the improved centric pier support comprises a torsion block assembly including a spherically rotatable torsion coupler; a platform configured for annular receipt of a torsion adapter; said torsion block assembly extending through a channel presented by said vertical support member at said torsion adapter; a vertical axis extending from said vertical support and extending through said torsion block assembly, said torsion adapter aligned with said torsion block and said vertical support, said torsion adapter configured for slidable receipt of said torsion block assembly and including an upper portion separated from a lower portion by a circular disc.

One embodiment of the torsion assembly includes a torsion block in threadable receipt of a torsion support which extends from a torsion adapter to an impact plate, the torsion block further including a torsion coupler with an outer planar surface and an inner concave surface for spherical rotation with a spherical support. A control member is positioned between and the torsion assembly providing for controlled spherical rotation of the torsion coupler from a horizontal orientation. In one embodiment, the control member provides for less than twenty degrees of rotation.

Another embodiment includes a method and device for an improved unicentric piering support which supports at least a portion of a building structure, said improved unicentric pier support comprising a vertical support member with a base segment having an inner support structure configured for receipt by an upper segment, said vertical support member aligned with a torsion assembly at a support platform with a torsion adapter, said torsion assembly including a torsion block and a torsion support. The torsion support is generally rotatable and configured for spanning the torsion block and the vertical support with a threaded member extending through the torsion adapter.

Generally, the torsion support provides vertical adjustment for the torsion assembly. In the depicted embodiment, the torsion block includes complementary receiving structure for threadably receiving the torsion support. The torsion block generally includes a spherical support member about which the torsion coupler can be rotatable extending and presenting a multiaxial joint, the spherical support having a male structure with a first compound curvature mated for receipt by the complementary structure associated with the torsion coupler. Generally, the torsion coupler presents an outer planar surface for contact with an impact plate or other building structure and an inner curved surface adapted for rotation about the spherical support.

In accordance with yet another embodiment of the present invention, there is provided a method for installing an improved centric pier support. The method includes closing one end of a base segment by installing a starter cap on an end of the base segment; placing a push block onto the open end of a base segment; placing a hydraulic ram having a piston on top of the push block; driving the closed end of the base segment a distance equal to one stroke of the piston; removing the push block and installing an inner support structure into the open end of the base segment; stacking an upper segment on top of the base segment with the inner support structure spanning both the base segment and the upper segment; driving the upper segment by placing the push block onto the upper segment and driving the upper segment a distance equal to one stroke of the piston; repeat the steps of removing the push block, stacking an upper segment and driving the upper segment until the desired vertical height is achieved; installing a torsion adapter into a platform; placing the platform onto the exposed end of the upper segment; sliding the torsion assembly through the torsion adapter until the torsion assembly is secured onto the platform; and adjusting the torsion assembly for engagement with an impact plate.

Certain embodiments of the invention are outlined above in order that the detailed description thereof may be better understood, and in order that the present contributes to the art may be better appreciated. There are, of course, additional embodiments of the invention that will be described below and which will form the subject matter of any claims appended hereto.

In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein as well as the abstract are for the purposes of description and should not be regarded as limiting.

As such, those skilled in the relevant art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

Further features of the present invention will become apparent to those skilled in the art to which the present invention relates from reading the following description with reference to the accompanying drawings, in which a better understanding of the present invention is depicted, in which.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
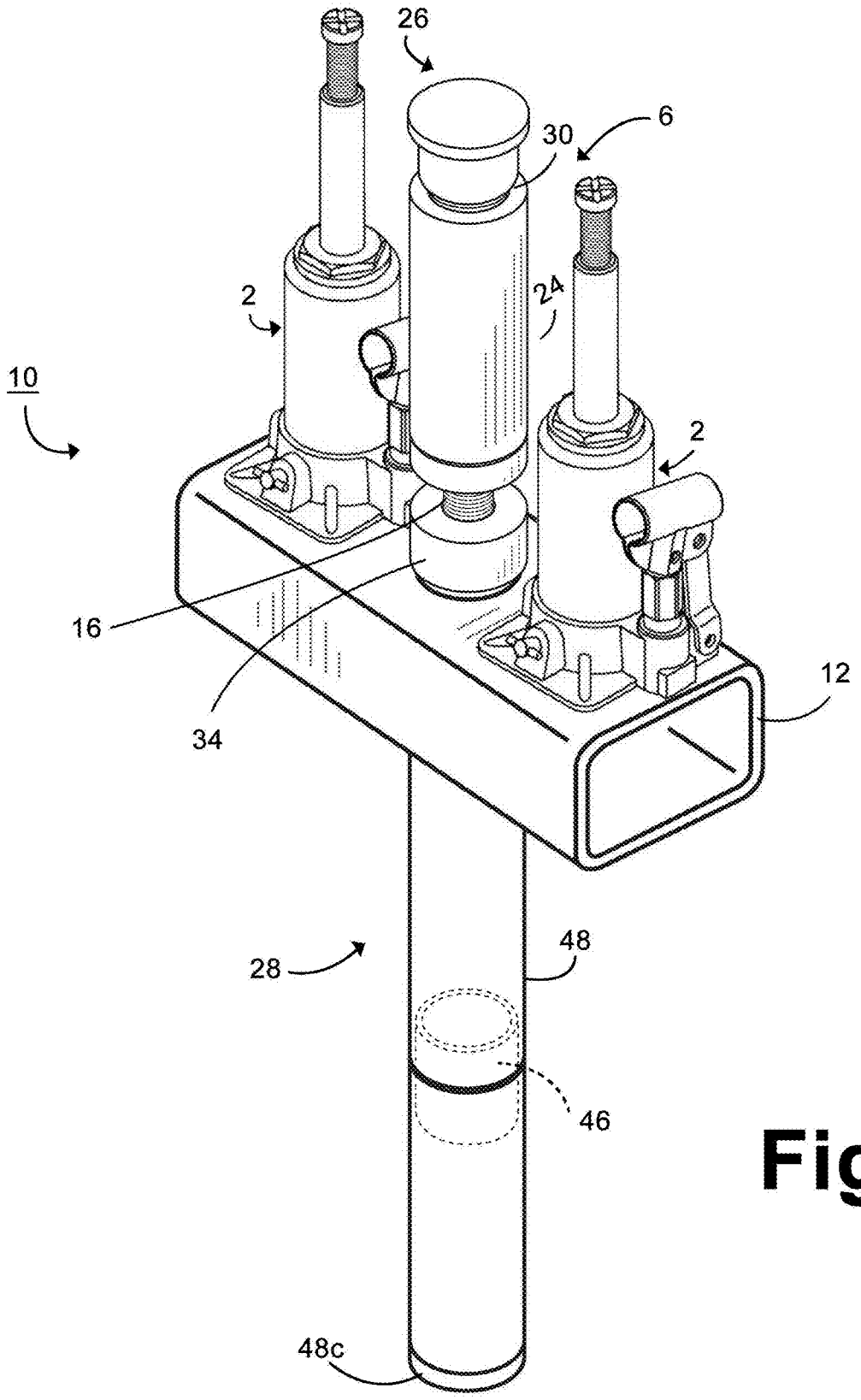
FIG. 1 is a side perspective of an exemplary environmental embodiment of the improved centric pier support illustrating optional lifters spaced a support platform.

Accordingly, the above problems and difficulties are obviated, at least in part, by an improved centric pier support 10 which provides improved support for a footing (not shown) associated with a building structure (not shown) for example during soil expansion and contraction. One embodiment of the present invention, is illustrated in FIG. 1 which includes an improved torsion assembly 20 extending from a platform 12 supported by a vertical support 28, also referred to as a vertical member. A central vertical axis 4 extends outwardly from a multiaxial support member 6 which is positioned along the platform 12 which allows for an angular rotation of the multiaxial support member 6 from the platform for supporting the footing (not shown).

The embodiment depicted in FIG. 1 illustrates two lifters 2, spaced along the support platform 12 for placement below or near a support footing. While the illustrated lifters are typical hydraulic jacks, other lifting devices may be used including rams, screw jacks as are already known. Fewer or additional lifting devices may be utilized depending on the specific lifting requirements. In addition, while the support platform 12 is depicted as a rectangular cross member, it may utilize different or alternative structure(s) for spaced receipt of the lifters 2 and for securing torsional assembly 20.

Generally, the multiaxial rotatable support member 6 provides the function of angled support of the footing and generally extends from the platform 12 and is secured to the vertical support 28. In the embodiment illustrated in FIGS. 1-12, the multiaxial rotatable support member 6 is generally depicted as a torsion assembly 20 which includes a torsion block 23 which is further illustrated in FIGS. 3 and 4 configured for receipt of a torsion support 21 which is further depicted in FIG. 6.

Figure 6:
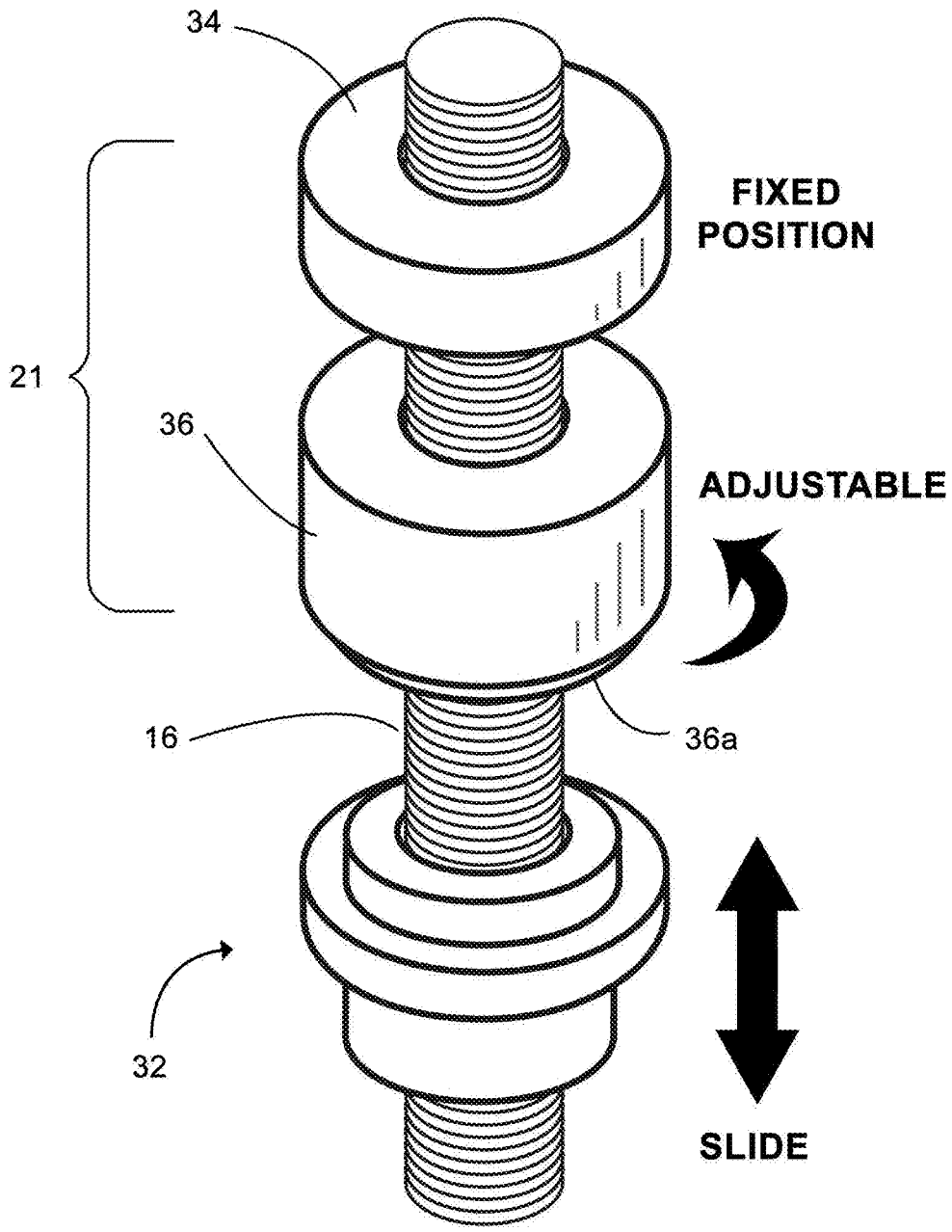
FIG. 6 is a front perspective of the torsion support in receipt by the torsion adapter in accordance with the embodiment of FIG. 2.

Generally, the torsion support 21 depicted in FIG. 6 includes a fixed ring receiver 34 and an adjustable ring receiver 36 both having a threaded opening configured for threaded receipt of a threaded shaft 16. Generally, the adjustable ring receiver 36 is rotatable for vertically adjusting the torsion assembly 20 in relation to the platform 12. The outer diameter of the adjustable ring receiver 36 is generally sufficient for rotation of the threaded shaft 16. The outer diameter of the fixed ring receiver 34 has sufficient dimensions for engagement with the torsion block 23.

Figure 3:
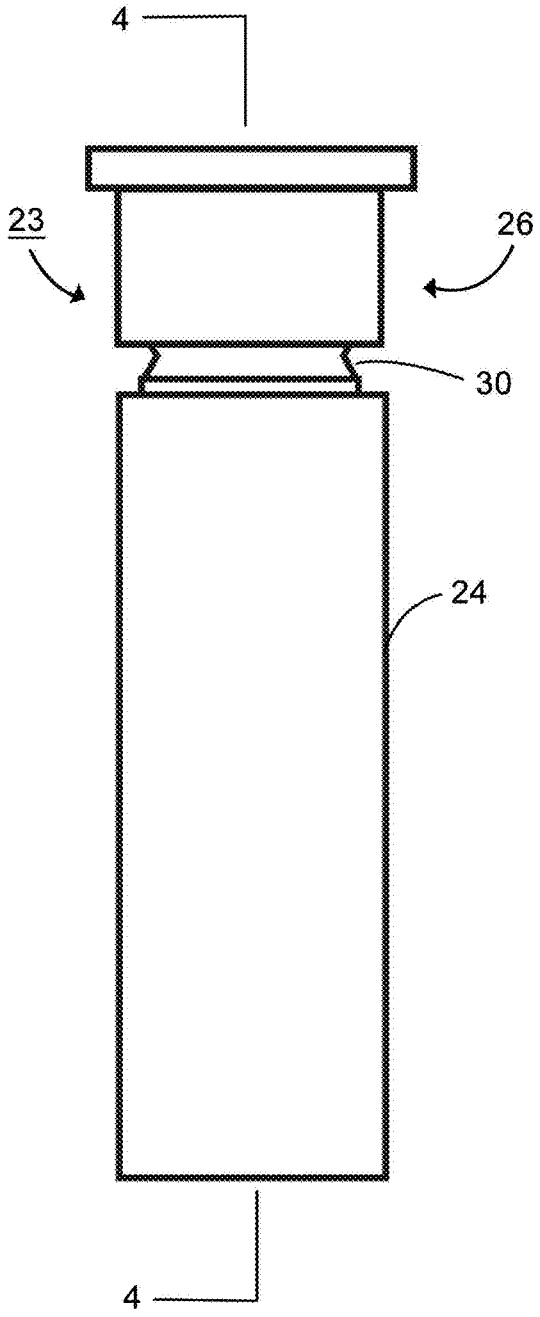
FIG. 3 is a side elevation of the torsion block according to the embodiment of the improved centric pier support according to FIG. 2.
Figure 4:
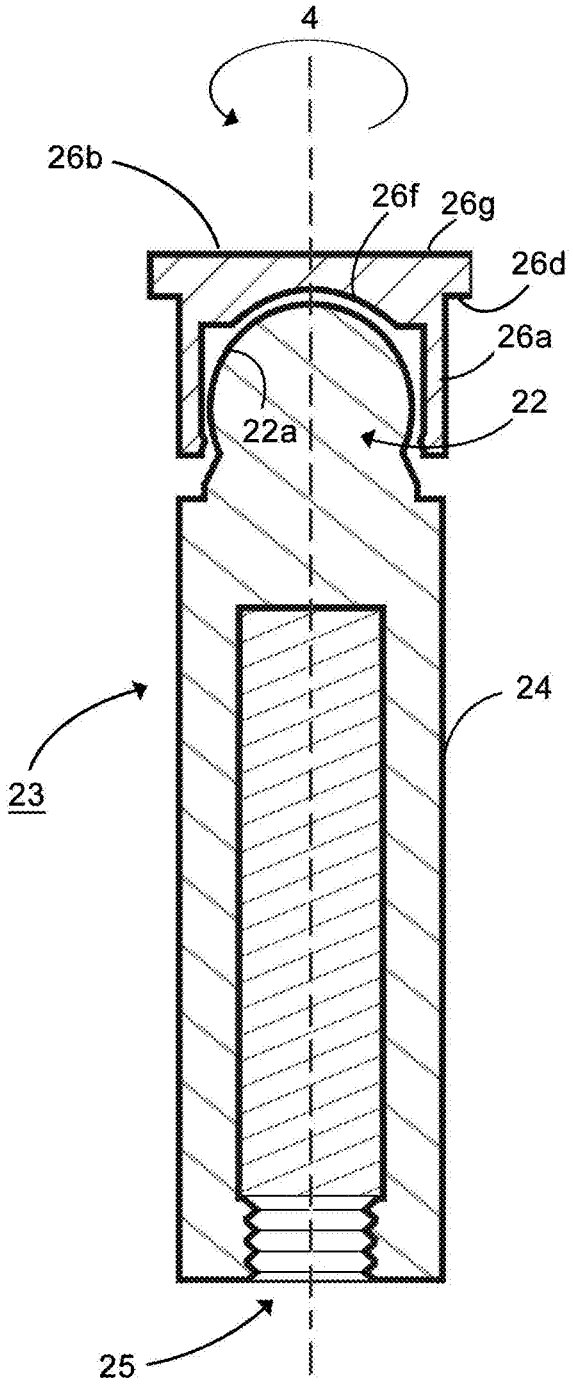
FIG. 4 is a cross-section of the torsion block in according to the embodiment of the improved centric pier support of FIG. 1 taken along the line 4-4 in FIG. 3.

The torsion block 23 depicted in FIGS. 3-4 includes a rotatable torsion coupler 26 with a cylindrical sidewall **26*c* extending down from a circular cap 26*b* and presenting an open end 26*e* configured for receipt of a spherical support 22. Generally, the rotatable torsion coupler 26 is spherically rotatable about multiple axis extending centrally through the spherical support 22 including a vertical axis 4 extending from the vertical member 28. The rotatable support member 6** is rotatable along multiple axis, including vertically and rotationally as desired for raising the associated building structure (not shown) while providing continuous angular support along the bottom of the footing (not shown).

Figure 2:
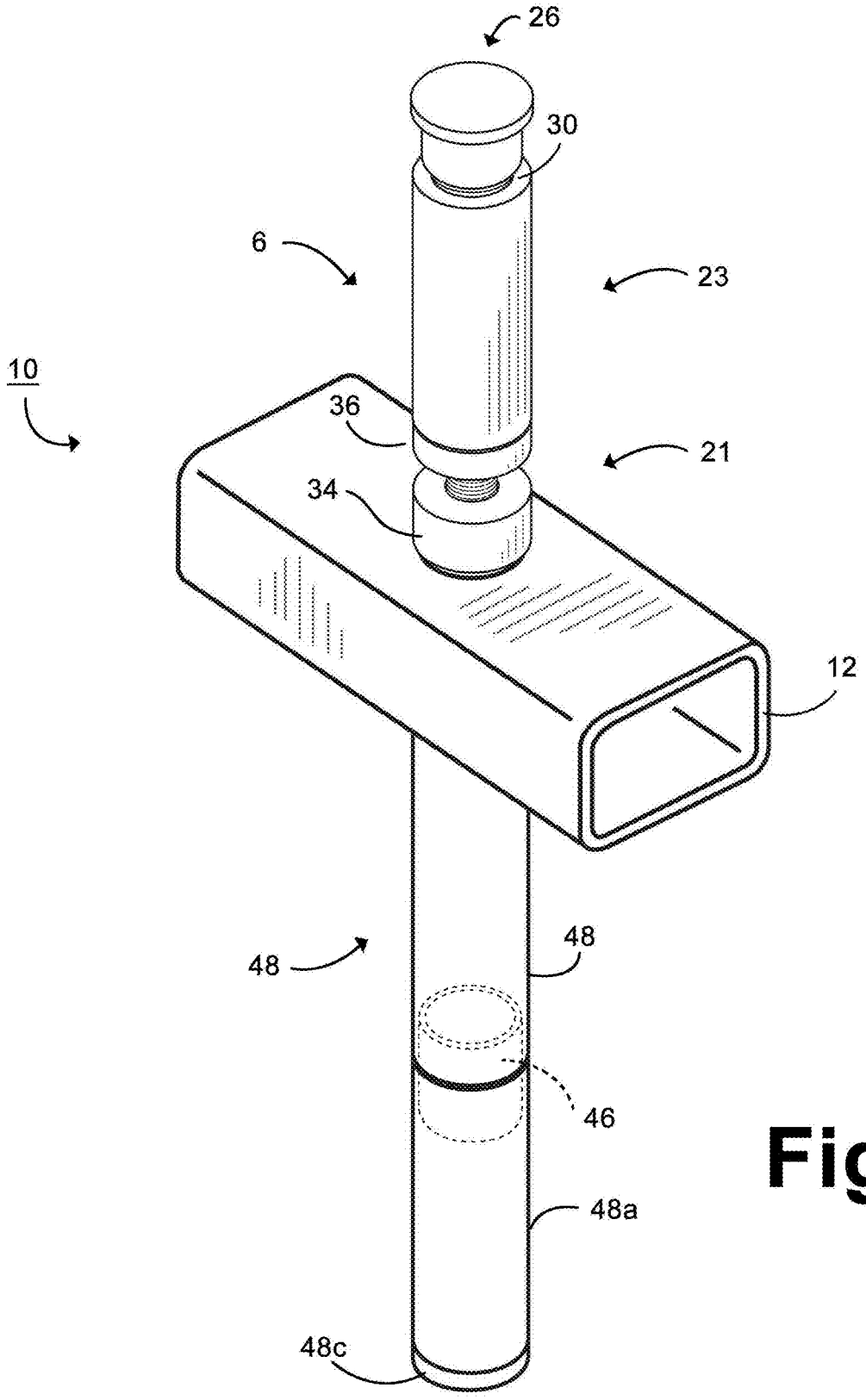
FIG. 2 is a side perspective of the exemplary embodiment of the improved centric pier support according to FIG. 1.
Figure 5:
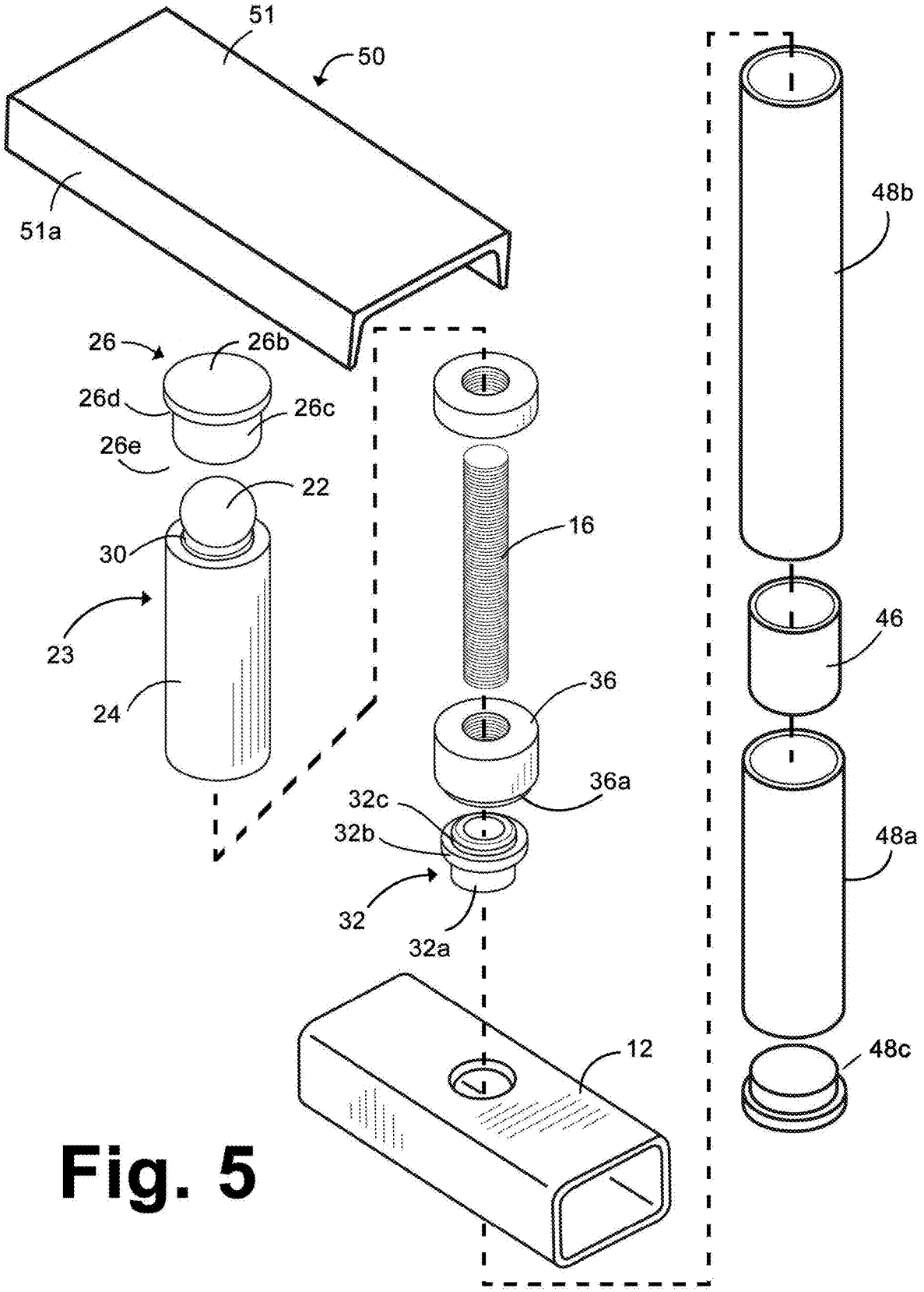
FIG. 5 is an exploded schematic view of the exemplary embodiment of the improved pier support according to FIG. 2 with an impact plate positioned for placement on top of the torsion assembly.

An embodiment of the support platform 12 is an elongated hollow rectangular metal structure with a pair of open ends and a top and a bottom, the top being orientated towards the building structure and the bottom orientated towards the ground surface (not shown) a cylindrical passage presented by the top and the bottom for receipt of the vertical support member 28. As depicted in FIGS. 1-2, and 5 the support platform 12 may consist of a cut steel rectangle channel member which in some cases may have a cross-section of around 4" by 6", but in one embodiment may be between 8" and 24" long. Generally, the support platform 12 has sufficient structural integrity for supporting a lifting device 2 positioned along the support platform 12 during elevation of the building structure. Generally, the lifting device 2 is well known and includes rams or jacks.

Figure 10:
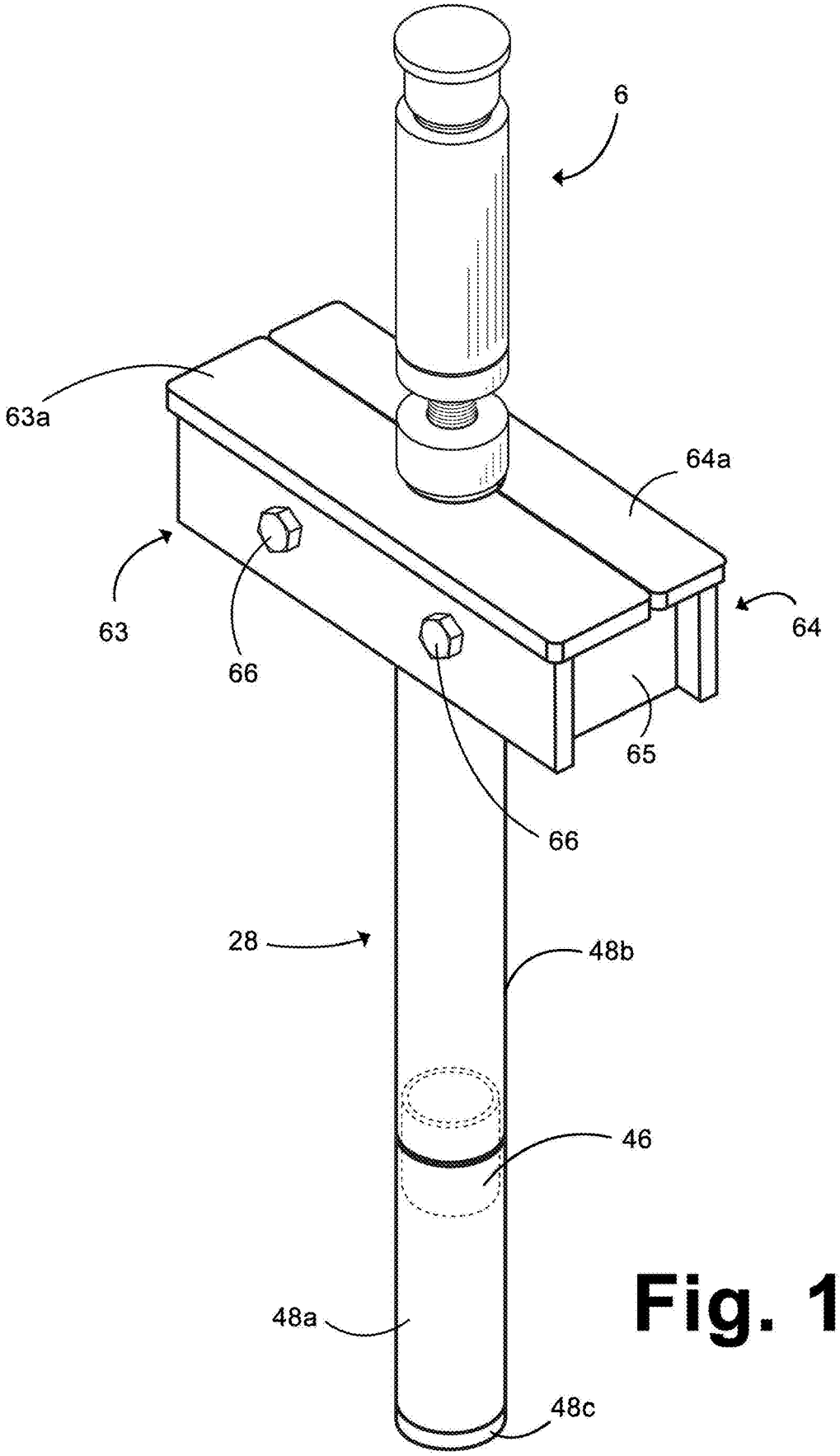
FIG. 10 is front perspective of an alternative embodiment of the improved centric pier support with a removable support platform.
Figure 11:
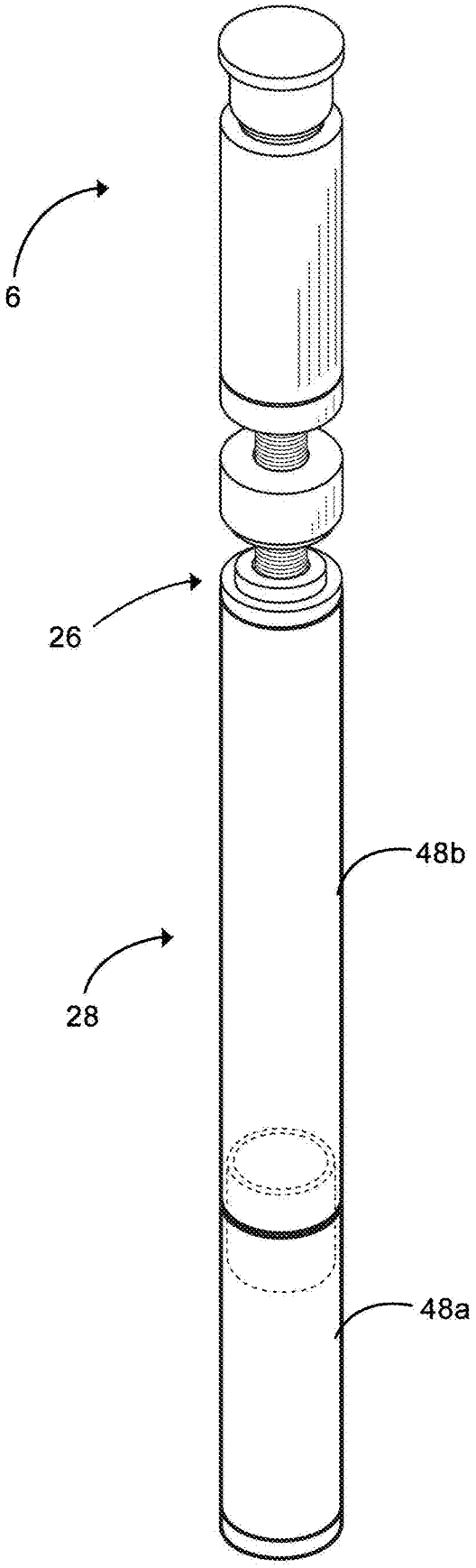
FIG. 11 is a front perspective of an alternative embodiment of the improved centric pier support of FIG. 10 with the removable support platform removed.

An alternative platform embodiment is depicted in FIG. 10 with a removeable support platform 62 having a front side 63 separable from and a back side 64. The front side 63 includes a top front 63*a*, the back side 64 including a top back 64*a*, the top front 63*a* and top back 64*a* presenting a circular opening (not shown) configured for receipt of the torsion coupler 26. A pair of ends 65 extend between the front side 63 and the back side 64 and a pair of threaded members (not shown) extending from the back 64 through a pair of circular apertures associated with the front side 63 and configured for receipt of a pair of threaded fasteners 66. After the vertical support member 28 is properly positioned the threaded fasteners 66 may be removed and the front side 63 may be separated from the back side 64, allowing the support platform 62 to be removed as depicted in FIG. 11, with the vertical support member 28 in receipt of the rotatable support 6 at the torsion coupler 26.

FIGS. 1-2 depicts the rotatable support member 6 as a generally cylindrical torsion assembly 20 which includes a cylindrical torsion block 23 configured for rotational receipt of the torsion support 21. The torsion block 23 includes an independently rotatable torsion coupler 26 which provides for spherical rotation along a plurality of axes. As depicted, the torsion assembly 20 is positioned centrally along the support platform 12 and in vertical alignment with a vertical axis 4 extending centrally through the vertical support member 28. The vertical support member 28 generally includes a cylindrical sidewall which presents an inner cylindrical channel 19 extending interiorly through the vertical support member 28. Generally, the cylindrical channel 19 extends radially to the interior sidewall of the outer support surface 48 for receipt of the inner support surface 46. The outer support surface 48 generally extends radially from an outer to an inner dimension a distance corresponding to the thickness of the cylindrical sidewall presented by the vertical support member 28 and presenting the channel 19, extending therethrough.

FIG. 1 illustrates the vertical support member 28 extending downwardly from the support platform 12. Traditional piers utilize a "head," "platform," or "bracket" which align and are typically centered over a vertical structure as the pier is driven into the ground. The vertical support member 28 generally utilizes a plurality of segments including a base segment 48*a* and an upper segment 48*b*. Both the base segment 48*a* and the upper segment 48*b* are depicted as being generally cylindrical each having a cylindrical outer sidewall and presenting the inner channel 19 extending through the formed support member 28.

In one embodiment, the improved centric pier 10 provides an improved pier which can be assembled and disassembled without the use of any welds or permanent joints. In the depicted embodiment, each stacked segment or part is configured for stacked engagement with the underlying components with a few components being configured for threaded engagement. In this way, the improved centric pier 10 is easy to install and set up.

An inner support structure 46 extends between the base and upper segments 48*a*, 48*b*, aligning the vertically stacked segments 48*a*, 48*b* as additional upper segments 48*b* are stacked onto the already received upper segment(s) 48*b*. The inner support structure 46 spans the stacked segments 48*a*, 48*b*. As depicted, the inner support structure 46 is cylindrical but may be rectangular or otherwise configured for aligning and stacking the upper segments 48*b* onto the base segment onto the base segment 48*a*. In operation, the height of the vertical support member 28 can be increased by staking additional upper segments 48*b* onto the base segment 48*a* or any other upper segments 48*b* as desired.

The illustrated embodiment of FIG. 2, shows the inner support structure 46 spanning the interior of the base segment 48*a* and the upper segment 48*b*. Each upper segment 48*b* stacked onto the base segment includes a pair of inner support structures 46 at each open end until the final upper segment 48*b*. Typically, the final upper segment 48*b* will be cut down to the desired size using a circular saw or another tool using, for example, a carbide disc. Generally, the inner support structure 46 provides the function of stacking and mechanically aligning adjacent vertical segments 48*a*, 48*b* to form the vertically extending support member 28. The depicted embodiment of the inner support structure 46 of FIGS. 1-2 is generally cylindrical presenting a circular cross-section.

The embodiment of the base segment 48*a* depicted in FIGS. 1-2, 10-11 includes a cylindrical sidewall with an open bottom configured for receipt of a starter cap 48*c* configured for receipt within the open bottom and engagement with the cylindrical sidewall of the base segment 48*a*. Generally, the starter cap 48*c*, the outer support structure 48 and inner support structure 46 are made from a rigid material like steel which can handle the stress and strain of the supported load. The open bottom associated with the base segment 48*a* has an inner diameter is generally greater than the outer diameter of the inner support structure 46 for slideable receipt thereof and generally corresponds to the inner diameter of the upper segment 48*b*.

The upper segment 48*b* is generally configured for receipt of the inner support structure 46 during stacked placement above the base segment 48*a*. Generally, the upper segment 48*b* includes a generally rigid cylindrical sidewall which is open at both ends for slidably receipt of the inner support structure 46 at both ends presenting the centrally extending channel 19 thereat. The centrally extending channel 19 is configured for slidable receipt of the inner support structure 46.

An exemplary novel method for using the present invention includes utilization of equal segment heights where the initial base segment 48*a*, combined with a push block (not shown) equals the height of the upper segment(s) 48*b*. For example, the base segment 48*a* may be 8" and the push block may be 7" which may be set to equal the height of the upper segment 48*b*, 15". A starter starter cap 48*c* is installed onto one end of the base segment 48*a* and the base segment is set up onto the ground in the desired position. A 12¾" hydraulic ram (not shown) with a 8¼" stroke is then set on top of the push block. The hydraulic ram (not shown) is then extended a full piston length, driving the base segment 48*a* down a distance equal to the upper segment 48*b*. The push block (not shown) is then removed and an inner support 46 is inserted into the open end of the base segment 48*a*, opposite the starter cap 48*c*. The upper segment 48*b* is then stacked onto the driven base segment 48*a* and the push block is then positioned on top of the exposed end of the upper segment 48*b*. The hydraulic ram (not shown) is then placed onto the push block and extended another full piston length driving the first upper segment 48*b* into the ground. Another inner support structure 46 is inserted into the open end of the first upper segment, a second upper segment 48*b* is then stacked over the first upper segment 48*b* and the push block is positioned over the exposed end of the second upper segment 48*b*. The hydraulic ram (not shown) is then placed onto the push block and extended another full piston length driving the second upper segment 48*b* into the ground. This process is repeated until the desired vertical height is achieved.

During installation of the inner support structure 46, it is positioned at the open end of the underlying vertically stacked segment and slid along the channel 19 for stacked receipt of an upper segment 48*b* in an overlying vertically aligned orientation. Generally, the inner support structure 46 will span the junction of the base segment 48*a* and the upper segment 48*b* and additional upper segments 48*b*. During stacked receipt of the upper segment 48*b* the inner support structure 46 aligns any received upper segments 48*b* as they are moved downward for stacked orientation. The inner diameter of the upper segment 48*b* corresponds to the inner diameter of the base segment 48*a* and both are greater than the outer diameter of the inner support structure 46 which is received by the centrally extending channel 19.

Upon reaching the desired height, the torsion adapter 32 is positioned for at least partial receipt within the open end of the uppermost upper segment 48*b*, the torsion adapter 32 being extended through a circular opening associated with the upper surface of the platform 12. Generally, the torsion adapter 32 includes a lower portion 32*a* separated from an upper portion 32*c* by a circular disc 32*b*. The lower portion 32*a* is generally configured for receipt by an open end associated with the upper segment 48*b*. The circular disc 32*b* is generally configured for annular receipt by the platform 12. In the depicted embodiment of the torsion adapter of FIG. 5, the upper portion 32*c* includes a flared end which may also present a threaded end for threaded receipt of the torsion assembly 20. The torsion adapter 32 provides the function of connecting the torsion assembly to the vertical support 28 at the platform 12. After the support platform 12 is installed onto the vertical support member 28, mechanical lifting devices such as rams or jacks 2 may be installed on the platform 12 and used to lift the associated building support structure (not shown).

FIG. 5 also includes an impact plate 50 which includes a "C" configured structure. The impact plate 50 includes a substantially planar surface 51 with a pair of dependent structures 51*a* extending downwardly from the substantially planar surface and configured for receipt of the substantially planar surface associated with the torsion coupler 26. In general, the impact plate 50 provides a planar surface to distribute the supported load, spreading out the received load over a larger surface to help avoid damage of the structure or pier. While the depicted impact plate 50 is depicted as being substantially flat, alternative configurations may include an angular structure or a channeled structure such as the alternative impact plates illustrated in FIGS. 8 and 9.

FIG. 6 illustrates an embodiment of the torsion support 21 including a threaded shaft 16 in receipt of a fixed receiver 34 and an adjustable receiver 36, the adjustable receiver having a tapered edge 36*a* for alignment with the torsion adapter 32. The torsion support 21 provides for vertical adjustment of the torsion assembly 20 as desired for proper support of the overlying structure by the improved centric pier 10. As illustrated, the lower end of the threaded shaft 16 is slidably received by the torsion adapter 32. The adjustable receiver 36 is generally rotatable about the threaded shaft 16 for vertical adjustment, as desired. The fixed receiver 34 ensures the torsion support 21 maintains proper contact with the torsion block 23 while the upper end of the threaded shaft 16 is threadably received by the torsion block 23.

Generally, the threaded shaft 16 resists torque as the torsion assembly 20 is vertically adjusted from the support platform 12. As depicted in FIG. 3, the lower end of the central shaft 16 is threadably received through the channel 19 presented by the upper segment 48*b* which extends through the support platform 12. In the depicted embodiment illustrated in FIG. 6, the threaded shaft 16 includes a plurality of circumferential threads for receipt by the torsion block 23.

Figure 7:
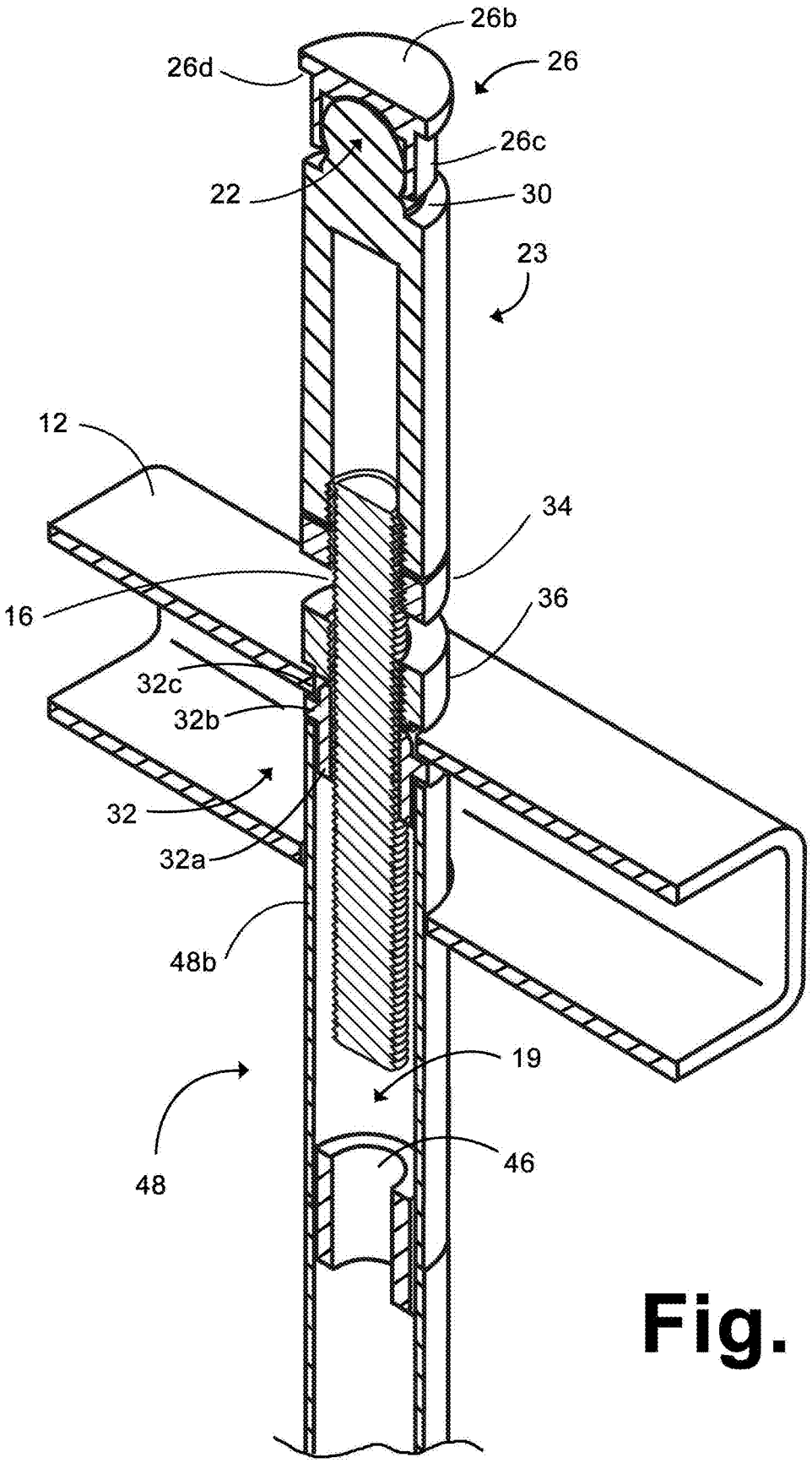
FIG. 7 is a cross-section of an embodiment of the improved centric pier support according to FIG. 2.

FIG. 7 illustrates a cross-section of an embodiment of the improved centric pier 10. As illustrated, the torsion block 23 threadably receives the torsion support 21 with the fixed receiver 34 positioned below to the torsion block 23. As illustrated, one end of the threaded shaft 16 associated with the torsion support 23 extends through the torsion adapter 32 to the channel 19 presented by the upper segment 48*b*.

The torsion block 23 is further depicted in FIGS. 3-4, with the cylindrical torsion tube 24. The cylindrical torsion tube 24 extends from an open threaded end 25 to the spherical support 22 which is configured for spherical rotation of the torsion coupler 26. The open threaded end 25 is configured for receiving the threaded shaft 16 and securing the torsion block 23 to the torsion support 21. Generally, the torsion assembly 20 is formed by rotating the open end 25 about the threaded shaft 16 until engagement by the fixed receiver 34. In this way, the torsion block 23 is secured to the torsion support 21. Vertical adjustment of the torsion assembly 20 is generally provided by rotating the adjustable receiver 36 about the threaded shaft 16. Once the adjustable receiver 36 is adjusted to the correct height, the torsion assembly 20 is slid through the torsion adapter 32. Vertical spacing is generally in relation to the spacing of the impact plate 50 from the platform 12. In this way, the torsion assembly 20 is spaced from the vertical support member 28 by rotating the adjustable receiver 36 downward to the torsion adapter 32.

The torsion coupler 26 is configured with a circular cap 26*b* supported by a cylindrical sidewall 26*c*, which is recessed within the circular cap 26*b* presenting a lip 26*d*. The circular cap 26*b* is generally circular although other configurations may be utilized. In addition, the outer surface of the circular cap 26*b* is substantially planar for engagement by the supported load (not shown) while the inner surface of the circular cap 26*d* includes a concave surface for receipt of the spherical support 22. The cylindrical sidewall 26*c* extends downwardly from the circular cap 26*b* to the open end 26*e*.

Generally, the torsion coupler 26 is mated for rotation about the spherical support 22 for rotation in both the lateral and horizontal directions with the torsion coupler 26 presenting a female parabolic or concave surface which is adapted for rotation about the spherical support 22. The torsion coupler 26 is generally mated for contact with the spherical support 22 along at least one contact point, the contact point being movable as the torsion coupler 26 rotates about the spherical support 22. In another feature, the contact point is a rolling point contact with the torsion coupler 26 moveable movable along both lateral and longitudinal axis.

The spherical support 22 and torsion coupler 26 are adapted for spherical rotation in engaged contact with each other. Generally, at least one of the contact surfaces including at least a curvilinear segment. As depicted in FIG. 4, the spherical support 22 includes a compound outer surface 22*a* also referred to as a male surface, while the torsion coupler 26 has an inner surface 26*f*, including a compound curvature, referred to as a female mating surface. The outer surface 22*a* and inner surface 26*f* are generally complementary shaped and may include a curved portion positioned next to another curved or linear segment which being complementary, allows for rotation. The inner surface 26*f* associated with the torsion coupler 26 is spaced opposite an outer surface 26*g* which is depicted as being substantially planar.

Generally, a control member 30 encircles the shaft of the spherical support 22 between the torsion tube 24 and the spherical support 22. The control member 30 limits spherical rotation of the torsion coupler 26 about the spherical support 22 from a posterior to an anterior position. The embodiment of the control member 30 depicted in FIGS. 3-4 is generally symmetrical with an outwardly tapered surface extending uniformly between the anterior and the posterior positions. Depending on the desired rotation of the torsion coupler 26, the control member 30 may have a variety of shapes including, regular or irregular with a symmetrical or asymmetrical surface to allow for varying angular rotation of the torsion coupler 26 between the posterior and anterior positions.

In one feature depicted in FIG. 4 the female mating surface of the torsion coupler 26 includes a parabolic portion to allow for multi-dimensional rotation. In the depicted embodiment, multi-dimensional spherical rotation is provided. In a yet another feature, the torsion coupler 26 includes a force transfer interface that is torsionally compliant relative to torsional moments exerted upon the torsion coupler 26 by the surrounding building structure and/or a shifting ground surface.

The control member 30 allows the improved rotatable support member 10 to avoid excessive rotation which may cause a conventional pier to become unstable leading to loss of vertical support. The control member 30 provides rotational stability by limiting the allowed spherical rotation between the outer surface 22*a* and the inner surface 26*f*. Specifically, the control member 30 presents an angle of rotation between the rotational axis extending through the torsion coupler 26 and the vertical axis 4 extending from the vertical support member 28.

The rotation of the torsional coupler 26 along the spherical support 22 may range between approximately 5 and 40 degrees, the degree of rotation being measured from the vertical axis 4 extending through the spherical support 22. Vertical alignment of the torsion coupler 26 is depicted in FIG. 4 with the vertical and rotational axis being aligned, the torsion coupler 26 being horizontally positioned and both axes extending normal to the substantially planar surface of the torsion coupler 26. In another embodiment, the rotation of the torsional coupler 26 about the spherical support 22 may cause the vertical axis to separate from the rotational axis.

As further illustrated in FIGS. 3-4, the circular control member 30 is positioned below the spherical support 22. Generally, the control member 30 encircles the base of the spherical support 22 and presents an outwardly tapered surface 30*a* between the torsion coupler 26 and the spherical support 22. Generally, the control member 30 limits the rotational freedom of the torsion coupler 26. The outwardly tapered surface 30*a* may include alternative configurations including having at least partially parabolic surface (not shown). In this way, the improved pier support system 10 provides rotational support for building structures (not shown) as the surrounding environment shifts or changes.

Figure 8:
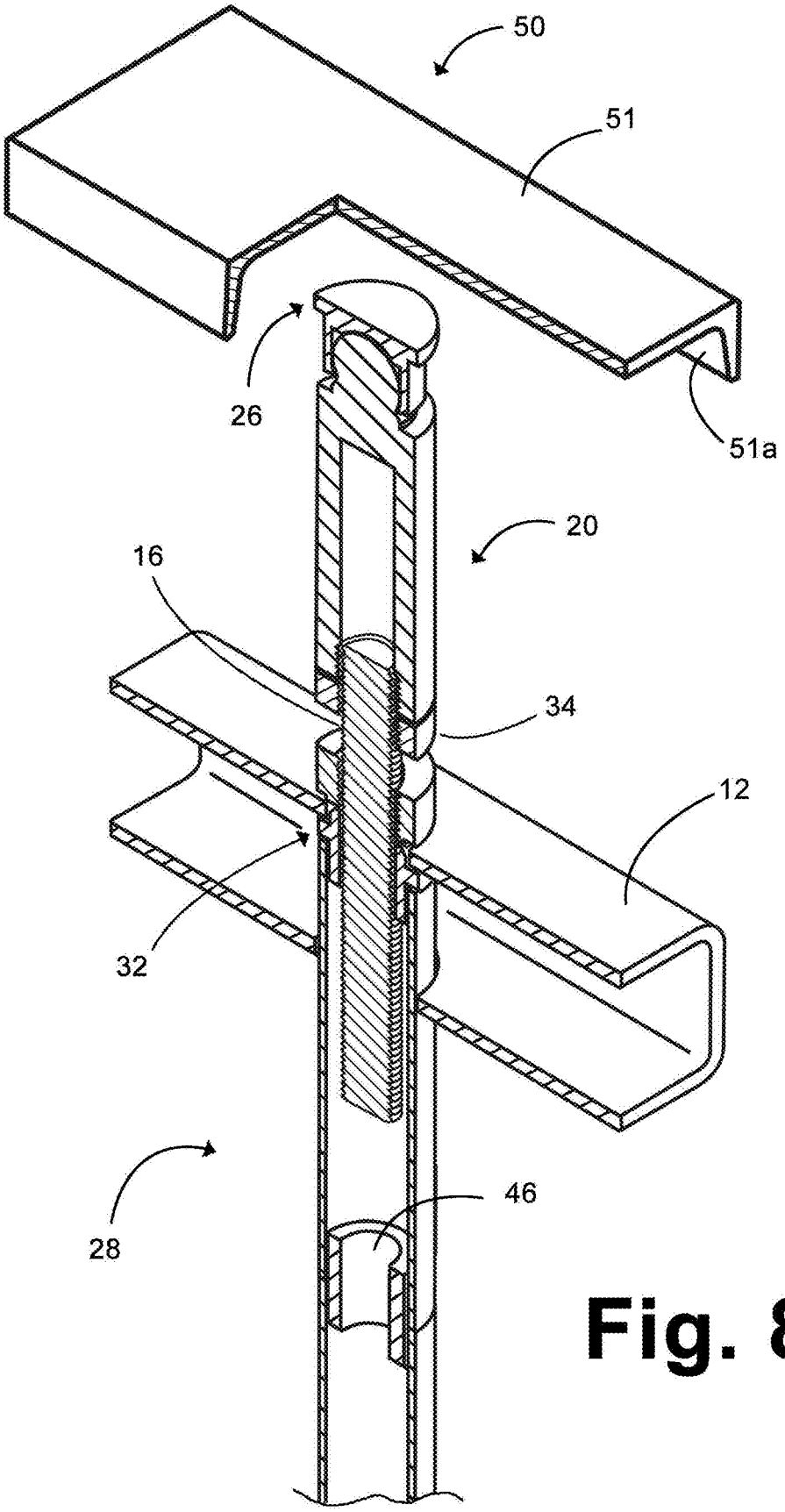
FIG. 8 is a cross-section of a second embodiment of the improved centric pier support with a portion of an impact plate positioned above the torsion assembly.
Figure 9:
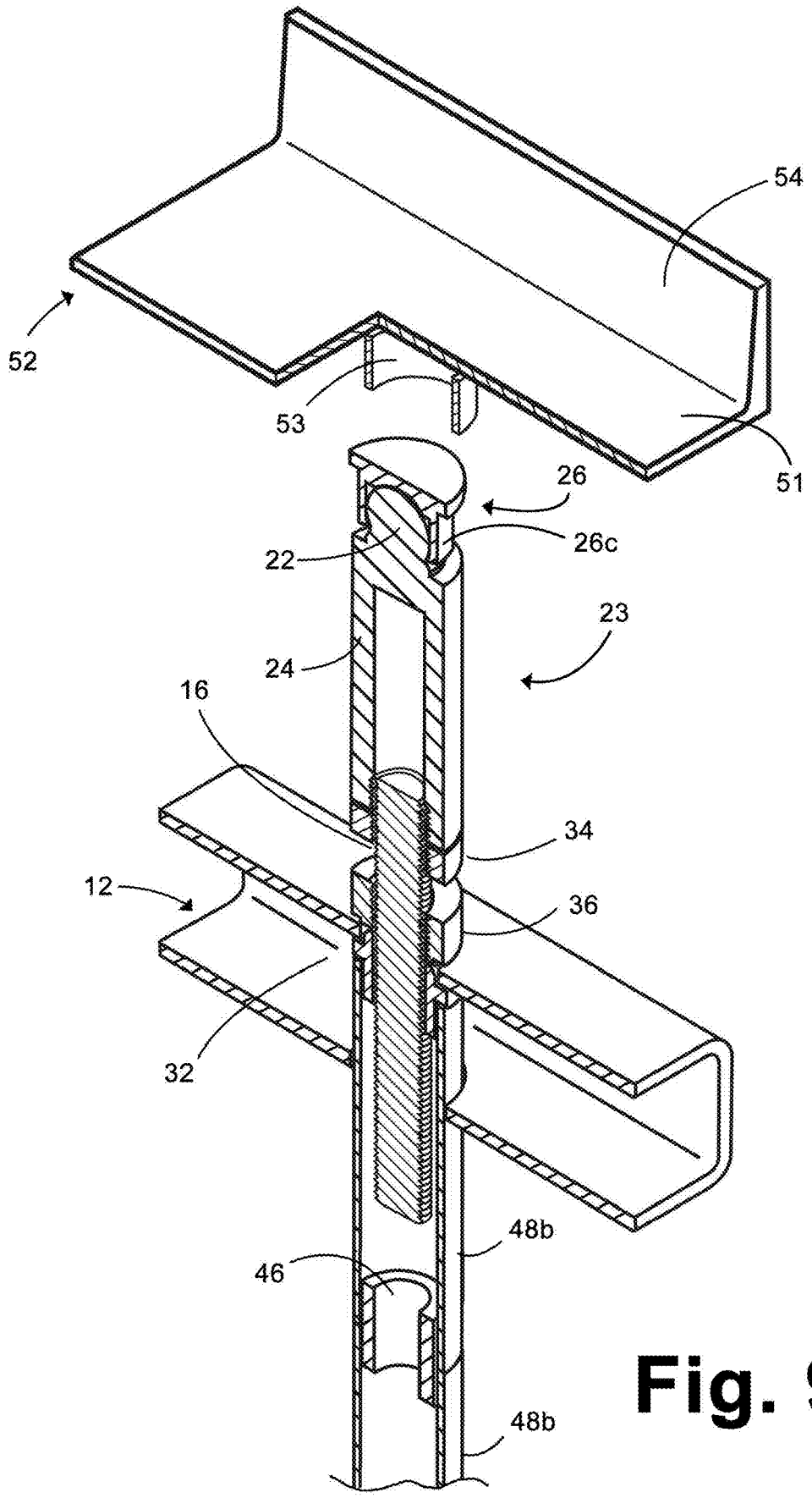
FIG. 9 is a cross-section of a third embodiment of the improved centric pier support with a portion of an alternative impact plate positioned above the torsion assembly.

In the depicted embodiment of FIGS. 7-9, the torsion adapter 32 allows for concentric alignment of the support platform 12 with the vertical support member 28 along an axis extending centrally through the vertical member 28, distributing the supported load along the outer edges of the vertical member 28. An unexpected benefit of the depicted alignment is that the vertical member 28 will maintain alignment with the support footing (not shown) even when surrounding soil (not shown) shifts.

Functionally, the torsion adapter 32 distributes the force received from the vertical member 28 along the support platform 12. The circular disc 32*b* rests against the inner sidewall of the support platform 12, distributing the supported load received from the torsion coupler 26 to the underlying vertical member 28. The supported load is communicated from the torsion coupler 26 through the torsion assembly 20, to the torsion adapter 32. The lower portion 32*a* is centrally positioned within the vertical member 28 for distributing the received load to the underlying vertical member 28.

Generally, the force exerted by the vertical member 28 upon the torsion adapter 32 is offset from the load exerted by the footing (not shown) upon the support platform 12. The offset load may be realized as a compression force exerted upon the torsion adapter 32. In conventional support piers (not shown), shifts in the surrounding environment, may cause the support load to increase based upon an overly rigid or immobile support structure. Over time, this lack of mobility may cause the conventional support pier to fail as the surrounding environment changes.

The embodiment of the improved pier support system 10 illustrated in FIG. 7 provides a multiaxial joint, such as a ball-and-socket joint for mated rotation between the torsion coupler 26 and the spherical support 22. Through the rotation of the torsion coupler 26 upon the spherical support 22, the torsion assembly 20 adjusts to the changing environment providing greater support in a shifting environment than may be provided with a rigid, immobile conventional support pier.

As surrounding earth and/or supported loads shift or when the pier is installed in an off-level orientation, conventional supports loose contact, in some cases up to 90%. As the load increases, the shear force exerted upon a conventional pier support also increases. The rotation of the torsion coupler 26 about the spherical support structure 22 maintains supported contact of the footing (not shown) associated with a support structure (not shown) upon the torsion coupler 26. Specifically, the male spherical support structure 22 is mated for receipt by the female torsion coupler 26, to maintain contact throughout the permitted rotation of the torsion coupler 26 about the spherical support structure 22. The control member 30 controls the rotation of the torsion coupler 26 about the spherical support structure 22 and generally allows for between 5 and 12 degrees of rotation from a generally horizontal orientation.

Generally, the control member 30 allows for between 5 and 10 degrees of spherical rotation of the torsion coupler 26 from a substantially horizontal position. In the substantially horizontal position, the central axis extending through and normal to the torsion coupler 26 is aligned with the vertical axis 4 extending through vertical member 28. In one exemplary embodiment, the control member 30 may limit rotation of the torsion coupler 26 to 8 degrees of rotation from the generally horizontal orientation. Generally, the torsion coupler 26 is rotatable over the spherical surface of the spherical support 22 in any direction along all three axes associated with the spherical support 22.

As the torsion coupler 26 rotates, the vertical component of the supported load may increase or decrease, in part, based upon the angular rotation of the torsion coupler 26 in relation to the central channel 19 (aligned with the threaded shaft 16). The control member 30 assists in limiting the angular rotation of the torsion coupler 26, thereby, maintaining the supported load within specific design parameters as the environment presents shifting conditions.

An alternative impact plate 52 is illustrated in FIG. 9, includes an upwardly extending angled support 54, extending from a substantially planar surface 51. The alternative impact plate 52 also includes a depending circumscribing collar 53 for encircling the torsion coupler 26 at the sidewall 26*c*. The alternative impact plate 54 may be beneficial, for example, when the improved pier support system 10 is installed along an outer support wall presenting a walled foundation support member. The optional collar 53 is configured for annular receipt of the torsion coupler 26 and for supporting the lip 26*d* of the torsion coupler 26 during spherical rotation.

It is to be understood that while certain forms of the present invention have been illustrated and described herein, it is not to be limited to the specific forms or arrangement of parts describer herein. Other arrangements or embodiments, changes and modifications not precisely set forth, which can be practiced under the teachings of the present invention are to be understood as being included within the scope of this invention as set forth in the claims below.

What is claimed and desired to be secured by Letters Patent:

1. An improved centric pier support comprising:

a torsion assembly including a spherically rotatable torsion coupler;

a platform configured for annular receipt of a torsion adapter;

said torsion assembly extending through a channel;

a vertical axis extending from a vertical support member and through said torsion assembly along said channel, said torsion adapter aligned with said torsion assembly and said vertical support member along said vertical axis, and said torsion adapter configured for slidable receipt of said torsion assembly and including an upper portion separated from a lower portion by a circular disc;

wherein said torsion assembly further includes a circumferential controller encircling a spherical support and configured for engagement by said spherically rotatable torsion coupler.

2. The improved centric pier of claim 1 wherein said control member further includes an outwardly tapered surface for engagement with a sidewall associated with said spherically rotatable torsion coupler.

3. The improved centric pier of claim 1 wherein said torsion assembly further includes a torsion tube extending from an open threaded-end to said spherical support.

4. The improved centric pier of claim 3 wherein said torsion assembly further includes a torsion support which includes a threaded member configured for receipt of a fixed receiver configured for fixed engagement with said torsion tube and an adjustable receiver configured for rotation along said threaded member for engagement with said torsion adapter.

5. A method of installing an improved pier support system the method comprising:

closing one end of a base segment by installing a starter cap on an end of the base segment;

placing a push block onto the open end of a base segment;

placing a hydraulic ram having a piston on top of the push block;

driving the closed end of the base segment a distance equal to one stroke of the piston;

removing the push block and installing an inner support structure into the open end of the base segment;

stacking an upper segment on top of the base segment with the inner support structure spanning both the base segment and the upper segment;

driving the upper segment by placing the push block onto the upper segment and driving the upper segment a distance equal to one stroke of the piston;

repeat the steps of removing the push block, stacking an upper segment and driving the upper segment until the desired vertical height is achieved;

installing a torsion adapter into a platform;

placing the platform onto the exposed end of the upper segment;

sliding the torsion assembly through the torsion adapter until the torsion assembly is secured onto the platform; and adjusting the torsion assembly for engagement with an impact plate.

6. An improved pier support comprising:

a vertical support member;

a platform operably connected to said vertical support member;

a torsion assembly which extends vertically from said platform;

said torsion assembly being independently rotatable about a plurality of axes;

said torsion assembly including a spherical structure and a torsion coupler received by said spherical structure; and a circular control member spaced between said spherical structure and said torsion coupler, wherein said torsion coupler is configured for spherical rotation during engaged contact with said spherical structure.

7. The improved centric pier of claim 6 wherein said torsion assembly rotates from a generally horizontal orientation.

* * * * *